US006394777B2

(12) United States Patent
Haavik

(10) Patent No.: US 6,394,777 B2
(45) Date of Patent: May 28, 2002

(54) COOLING GAS IN A ROTARY SCREW TYPE PUMP

(75) Inventor: Harold K. Haavik, Norwalk, CT (US)

(73) Assignee: The Nash Engineering Company, Trumbull, CT (US)

( * ) Notice: Subject to any disclaimer, the term of this patent is extended or adjusted under 35 U.S.C. 154(b) by 0 days.

(21) Appl. No.: 09/751,827

(22) Filed: Dec. 29, 2000

Related U.S. Application Data

(60) Provisional application No. 60/174,864, filed on Jan. 7, 2000.

(51) Int. Cl.[7] ..... F03C 2/00

(52) U.S. Cl. ..... 418/85; 418/90; 418/91; 418/93; 418/94; 418/101; 418/201.1

(58) Field of Search ..... 418/201.1, 85, 418/101, 90, 94, 91, 83

(56) References Cited

U.S. PATENT DOCUMENTS

| | | | | |
|---|---|---|---|---|
| 3,531,227 A | | 9/1970 | Weatherston | |
| 3,801,446 A | * | 4/1974 | Sparber et al. | 176/39 |
| 3,965,681 A | | 6/1976 | Wyczalek et al. | |

(List continued on next page.)

FOREIGN PATENT DOCUMENTS

| | | | | |
|---|---|---|---|---|
| DE | 197 45 615 A1 | | 4/1999 | |
| EP | 0 777 053 A1 | | 6/1997 | |
| JP | 52062715 | | 5/1977 | |
| JP | 57013285 | | 1/1982 | |
| JP | 61226583 | | 10/1986 | |
| JP | 4-63997 | | 2/1992 | |
| JP | 4063997 | | 2/1992 | |
| JP | 05-164076 | * | 6/1993 | 418/201.1 |
| WO | WO 99/19630 | | 4/1999 | |

OTHER PUBLICATIONS

Cao, Yiding et al., "An Analytical Study of Turbine Disks Incorporating Radially Rotating Heat Pipes," HTD–vol. 361–3/PID–vol. 3, Proceedings of the ASME Heat Transfer Division—vol. 3, ASME 1998, pp. 103–110.

Babenko, V. A. et al., "Compressor–Adsorber with a Heat Pipe," Journal of Engineering Physics and Thermophysics, Russian Original vol. 69, No. 4, Jul.–Aug. 1996, pp. 413–419.

Bloch, Heinz P., "A Practical Guide to Compressor Technology," McGraw–Hill, 1996, pp. 151–177.

Langston, L. et al., "Heat Pipe Turbine Vane Cooling," Conference Title: Advanced Turbine Systems Annual Program Review, Conference Sponsor: U.S. Department of Energy, Office of Power Systems Technology, Conference Dates: Oct. 17–19, 1995, pp. 1–9.

(List continued on next page.)

*Primary Examiner*—Thomas Denion
*Assistant Examiner*—Theresa Trieu
(74) *Attorney, Agent, or Firm*—Fish & Neave; Robert R. Jackson; James A. Leiz

(57) ABSTRACT

A rotary screw type pump is provided with internal cavities within the rotors. The rotors include shaft portions that extend out from the casing that contains the screw portion of the rotors. The cavities extend from the screw portion of the rotors at the compression side of the casing to the shaft portion of the rotors. The cavities are charged with a fluid and may include a porous wick in order to act similar to a heat pipe for removing the heat generated during pump compression. The heat is transferred to the shaft portion of the rotors. The shaft portion of the rotors extend into a cavity that contains a coolant. A water jacket surrounds the cavity. The heat is transferred from the shaft portion of the rotors to the coolant and then the water jacket for removal. The heat transfer from the shaft portions to the coolant may be facilitated with the use of fins.

17 Claims, 4 Drawing Sheets

U.S. PATENT DOCUMENTS

| | | | | | |
|---|---|---|---|---|---|
| 3,999,400 | A | | 12/1976 | Gray | |
| 4,047,198 | A | * | 9/1977 | Sekhon et al. | 357/82 |
| 4,069,673 | A | | 1/1978 | Lapeyre | |
| 4,218,179 | A | | 8/1980 | Barry et al. | |
| 4,220,197 | A | | 9/1980 | Schaefer et al. | |
| 4,240,257 | A | | 12/1980 | Rakowsky et al. | |
| 4,429,546 | A | | 2/1984 | Fisher et al. | |
| 4,781,553 | A | * | 11/1988 | Nomura et al. | 418/104 |
| 4,957,417 | A | * | 9/1990 | Tsuboi | 418/201.1 |
| 4,983,106 | A | * | 1/1991 | Wright et al. | 418/84 |
| 5,924,855 | A | | 7/1999 | Dahmlos et al. | |
| 6,062,302 | A | * | 5/2000 | Davis et al. | 165/104.26 |
| 6,139,298 | A | * | 10/2000 | Kojima et al. | 418/201.1 |

OTHER PUBLICATIONS

Garg, S.C., "Investigation of Heat Pipe Technology for Naval Applications," Naval Civil Engineering Laboratory, Port Hueneme, California 93043, Technical Note N–1207, ZFXX–512–001–018, pp. 1–50, Feb. 1972.

Gray, Vernon H., "The Rotating Heat Pipe—A Wickless, Hollow Shaft for Transferring High Heat Fluxes," ASME–AICHE Heat Transfer Conference, Minneapolis, MN, Aug. 1969, pp. 1–5.

Press Release, Dry Screw Vacuum Pump, Bomoon Co., Ltd., #71–1, Sek San–Ri, Doug–Eup, Changwon, Kyongsang-nam–do, Korea (undated).

* cited by examiner

COOLING GAS IN A ROTARY SCREW TYPE PUMP

This application claims the benefit of U.S. provisional application No. 60/174,864, filed Jan. 7, 2000, which is hereby incorporated by reference herein in its entirety.

BACKGROUND OF THE INVENTION

This invention relates to rotary screw type pumps, and more particularly to incorporating heat pipe technology into rotary screw type pumps to increase their efficiency.

Screw type pumps are well known, as is shown, for example, by Matsubara et al. U.S. Pat. No. 4,714,418 and Im U.S. Pat. No. 5,667,370. In a conventional screw type pump, the temperature of the pumped gas rises during compression. Compression generally occurs towards the output end of the pump and the temperature of the gas there can increase dramatically. This particularly occurs when the input gas is at a low pressure. The increase in temperature reduces the efficiency of the pump and requires an increase in the operating tolerances within the pump, which increases leakage within the pump.

One current method of decreasing the gas temperature rise is to cool the outer casing of the pump with a water jacket. Another method is to bleed relatively cool gas (e.g., atmospheric air if the pump is pumping air) into the pump or to recirculate some of the output flow, which has undergone cooling, back into the pump. If the input gas pressure is close to or greater than atmospheric pressure, then the gas that is bled into the pump may need to be at a pressure that is greater than atmospheric pressure. While these methods achieve a certain degree of cooling, temperatures in excess of 400° F. may still be reached in air vacuum pumps, for example. This large increase in temperature at the output end of the pump causes an axial temperature gradient along the length of the rotors. The large temperature gradient and the differential temperature between the rotors and casing require the pump design to have larger operating clearance than if the parts were more uniform in temperature.

The operating clearance between the rotors and the casing is the controlling factor in the amount of internal leakage within the pump. Internal leakage within the pump is a significant contributing factor to the gas temperature rise at the output end of the pump.

A simple high-flux heat transport device exists that utilizes evaporation, condensation, and capillary action of a working fluid in a sealed container. The high-flux heat transport device is known generally as a heat pipe. The heat pipe was developed for use in a zero gravity space environment. The heat pipe has a very high effective thermal conductivity.

In view of the foregoing, it is an object of this invention to incorporate the heat pipe technology into rotary screw type pumps to increase their efficiency.

It is a more particular object of this invention to decrease the gas temperature rise within the pump.

It is a further object of this invention to decrease the amount of internal leakage within the pump.

SUMMARY OF THE INVENTION

These and other objects of the invention are accomplished in accordance with the principles of the invention by providing cavities within the rotors of rotary screw type pumps. The rotors include shaft portions that extend out from the casing that contains the screw portion of the rotors. The shaft portions on the compression side of the pump extend into a chamber and may include fins. The chamber contains a coolant fluid and outside the chamber is a water jacket.

Cavities within the rotors extend from the screw portion of the rotors at the compression side of the chamber to the shaft portion of the rotors. The cavities contain a fluid and may have a porous wick on their surfaces. During operating of the pump, as the gas temperature increases due to compression, the fluid within the screw portion of the rotors evaporates in the portion of the cavities within the screw portion of the rotors. The evaporated fluid then condenses in the portion of the cavities that are in the chamber. The wick facilitates the movement of the condensed fluid back to the portion of the cavities within the screw portion of the rotors. The wick may not be required in all embodiments for satisfactory operation of the apparatus.

This process removes the heat generated during gas compression within the casing and transfers the heat to the shaft portion of the rotors. The heat is transferred from the shaft portion of the rotors to the coolant and then the water jacket for removal.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
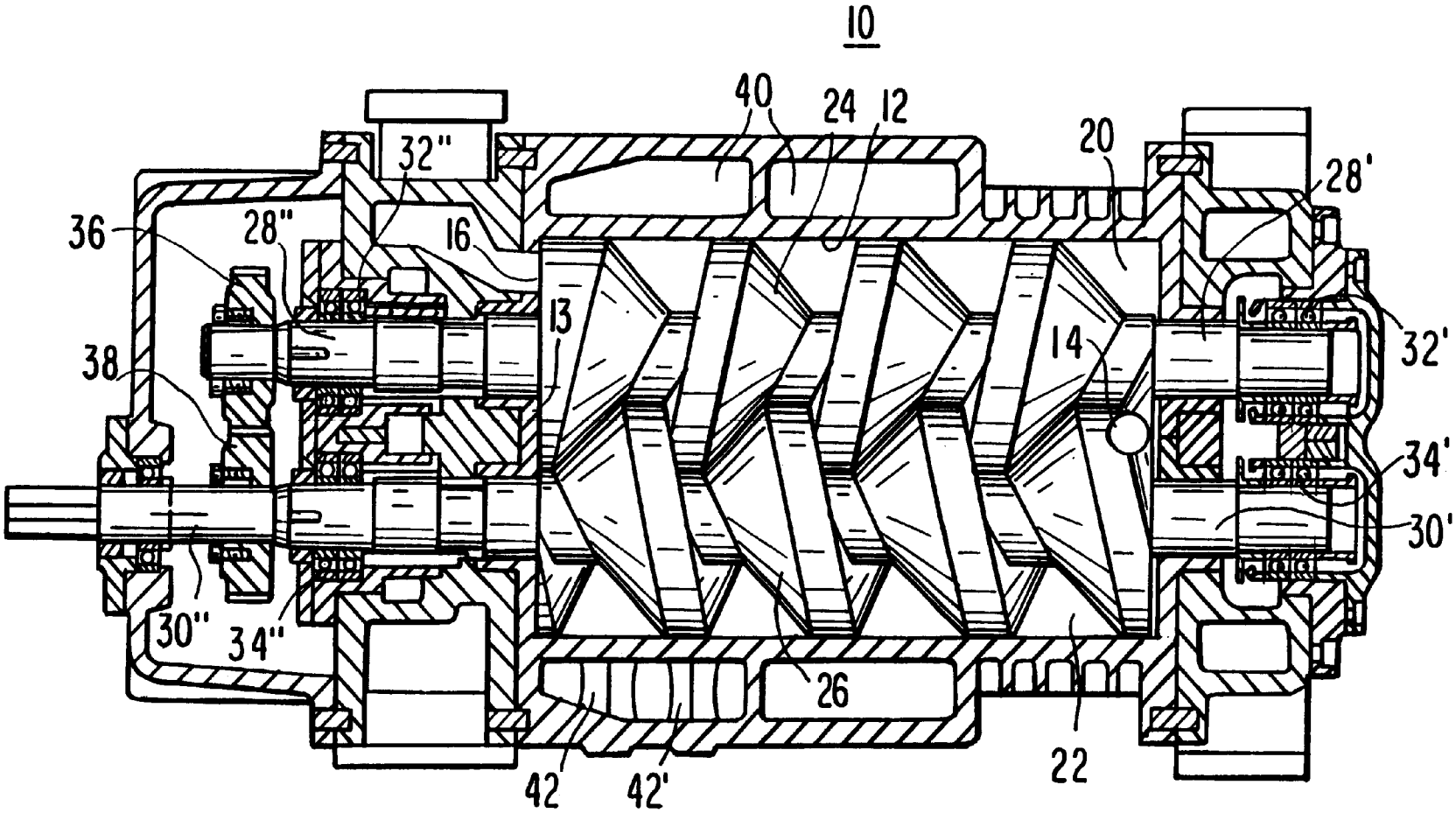
FIG. 1 PRIOR ART
FIG. 1 is a simplified sectional view of a conventional rotary screw pump.

The typical prior screw pump 10 shown in FIG. 1 includes a casing (or housing) 12, which has an inlet port 14 at one end thereof and an output port 16 at the other end thereof. Casing 12 includes two cylindrical chambers 20 and 22 in which intermeshing screw rotors 24 and 26 are respectively disposed. Intermeshing rotors 24 and 26 are arranged to provide a minimal operating clearance between each other and casing 12. Rotor 24 includes shaft portions 28' and 28", which are rotatable in bearings 32' and 32", respectively. Similarly, rotor 26 includes shaft portions 30' and 30", which are rotatable in bearings 34' and 34", respectively. One of the shaft portions, such as shaft portion 30", for example, may extend outward from casing 12 for connection to a suitable motor (not shown) in order to drive rotors 24 and 26. The rotations of intermeshing rotors 24 and 26 are coordinated with timing gears 36 and 38, respectively, which insure that rotors 24 and 26 rotate at the same speed in opposite directions.

In operation of pump 10, as intermeshing rotors 24 and 26 rotate, cavities enclosed by casing 12 and rotors 24 and 26 are formed at the inlet end of casing 12. As the cavities are formed, fluid is drawn into the cavities via inlet port 14. Once the cavities are formed, the cavities are conveyed through casing 12 towards output port 16. When a cavity reaches output end 13 of casing 12, the cavity decreases in volume and the fluid enclosed within the cavity is compressed and expelled through output port 16.

Casing 12 may include a water jacket 40. Water jacket 40 may be used to disperse the heat generated during compression of the fluid. As shown, water jacket 40 is concentrated about output end 13 of casing 12 at which compression occurs.

As discussed in the foregoing, atmospheric air or any other suitable fluid may be bled into the cavities, for example, at bleed points 42 and 42', to lower the fluid temperature within the cavities.

While the above-described pump features address the concerns of decreasing the temperature buildup at the compression end of casing 12, significant temperature buildup still occurs.

Figure 2:
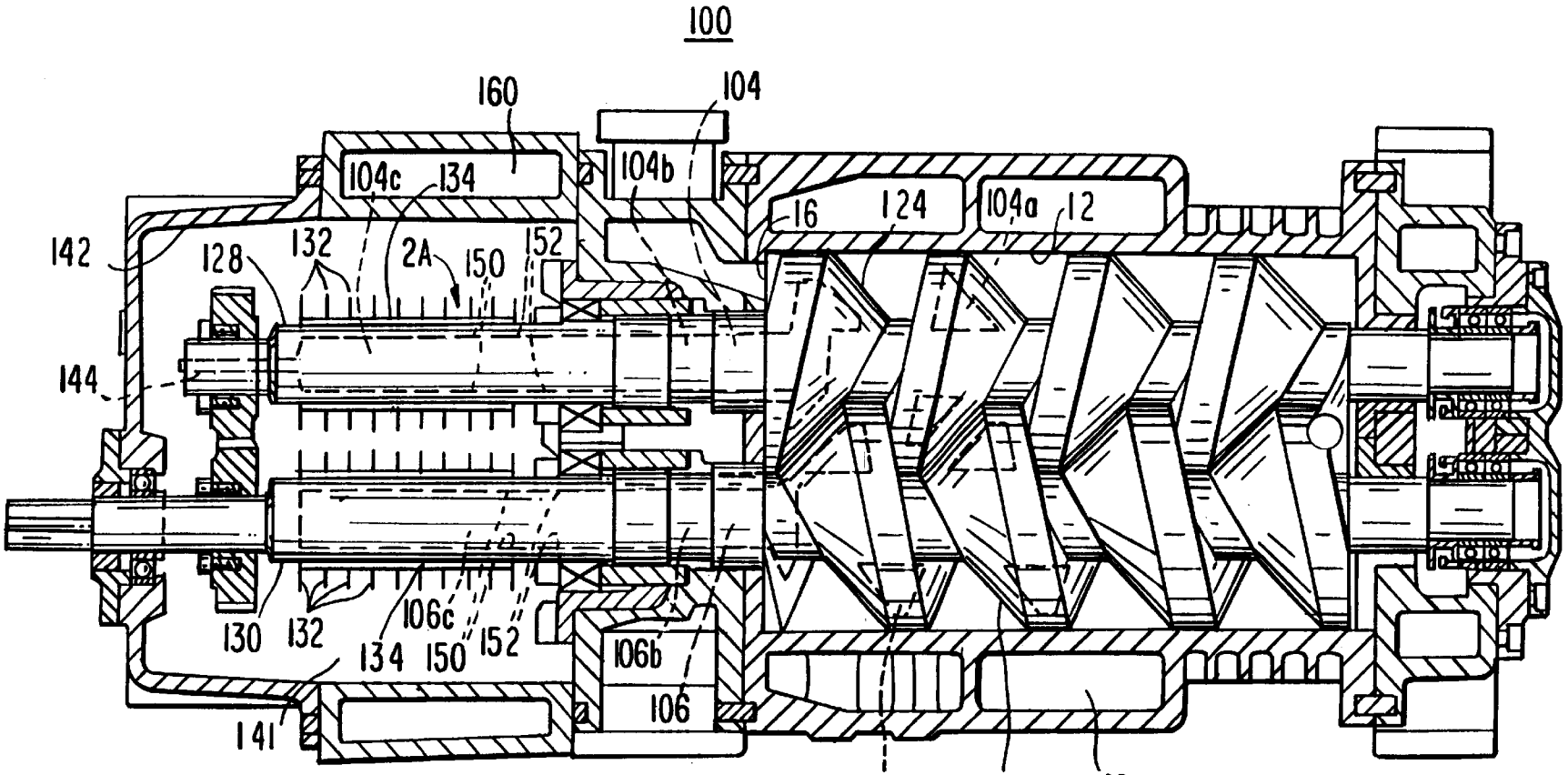
FIG. 2 is a simplified sectional view of an illustrative embodiment of a rotary screw pump in accordance with the invention.

Illustrative screw pump 100 constructed in accordance with the present invention is shown in FIG. 2. To facilitate comparison to pump 10 as shown in FIG. 1, components of pump 100 that are similar to components of pump 10 are given the same reference numbers as they have in FIG. 1. Intermeshing screw rotors 124 and 126 within casing 12 of FIG. 2 include cavities 104 and 106, respectively. Cavities 104 and 106 may extend from respective shaft portions 128 and 130 into a portion of the screw section of rotors 124 and 126 at the compression end of casing 12. Cavities 104 and 106 perform the same function in their respective rotors. Therefore, the function will be described in detail for cavity 104, and it will be understood that cavity 106 performs the same function.

Figure 3:
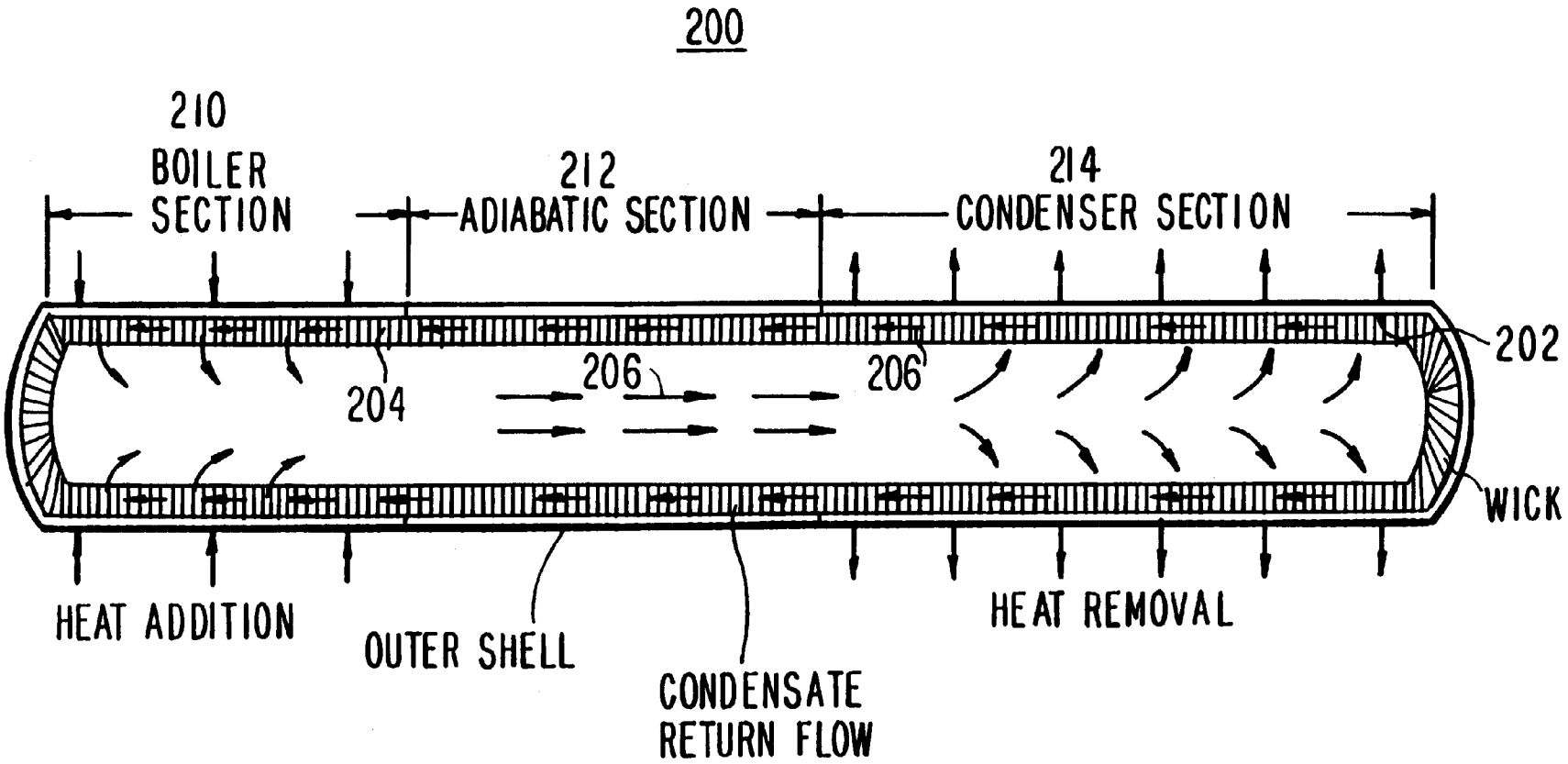
FIG. 3 PRIOR ART
FIG. 3 is a simplified sectional view of a conventional heat pipe.

The general principle behind cavity 104 is illustrated in a typical heat pipe 200 as shown in FIG. 3. Heat pipe 200 is a high-flux heat transfer device that, depending upon its configuration, can have a thermal conductivity greater than one thousand times that of copper. Heat pipe 200 includes a closed outer shell 202, a porous wick 204 that lines the inside of closed outer shell 202, and a fluid 206 contained within closed outer shell 202. Heat is added at the boiler or evaporation section 210 of heat pipe 200, which causes fluid 206 to evaporate. The evaporation of fluid 206 increases the pressure in boiler section 210 and causes a pressure differential in heat pipe 200. This pressure differential drives evaporated fluid 206 through adiabatic section 212 to condenser section 214 where condensation occurs and heat is released. The cycle is completed with condensed fluid 206 returning to boiler section 210 by the capillary action of the porous wick 204. Typical heat pipes, such as heat pipe 200, are designed for static application.

In the present invention, cavity 104 is dynamic in that it rotates with rotor 124. Cavity portion 104*a* of cavity 104 within casing 12 corresponds to the boiler or evaporator section. Cavity portion 104*a* is spiral shaped and follows the contour of the screw. The wall thickness of the spiral shaped portion of rotor 124 about cavity portion 104*a* may be thin to increase the heat transfer rate between the compression portion of pump 100 and cavity portion 104*a*. While cavity portion 104*a* is illustrated in a helical shape, it will be understood that cavity section 104*a* may be screw shaped or cylindrical.

Cavity portion 104*b* is cylindrically shaped and corresponds to the adiabatic section. External to cavity portion 104*b*, shaft portion 128 is generally enclosed within one or more bearings and a seal area that prevents fluid from escaping from casing 12. Cavity portion 104*b* links cavity portion 104*a* with cavity portion 104*c*.

Cavity portion 104*c* is cylindrically shaped and corresponds to the condenser section. Shaft portion 128 may have a larger diameter and be longer axially than a typical shaft portion that does not contain a cavity such as cavity 104. By increasing the diameter and increasing the axial length of shaft portion 128, the area for condensation increases. The wall thickness of shaft portion 128 about cavity portion 104*c* may be thin to help increase the heat dissipation of the condenser section to its surroundings. In order to facilitate heat transfer to the surroundings, the external portion of shaft portion 128 may include fins, such as fins 132. Fins 132 may be included on a sleeve 134 that fits over shaft portion 128. Fins 132 and sleeve 134 may be formed out of aluminum for good heat transfer properties. The end of shaft portion 128 may include an access hole 144 to allow cavity 104 to be primed with a fluid 150. Access hole 144 may be created by drilling the end of shaft portion 128. Access hole 144 is sealed during operation with any suitable plug (not shown).

Figure 2A:
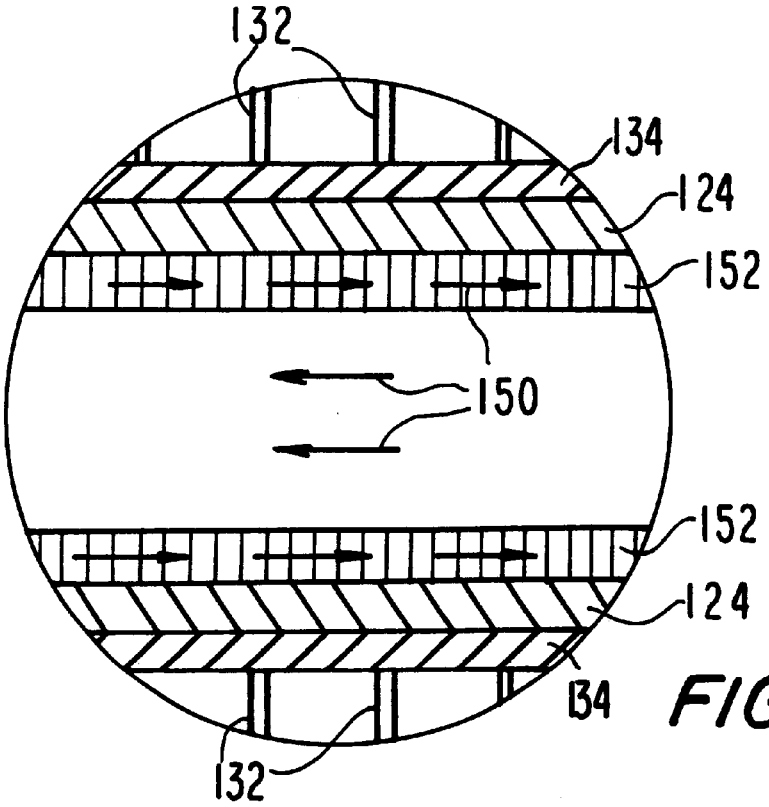
FIG. 2A is an enlargement of a portion of FIG. 2, taken at the location indicated by arrow 2A of FIG. 2.

Cavity 104 may be lined with a wick 152. FIG. 2A shows an enlargement of a portion of rotor 124 taken at arrow 2A of FIG. 2. FIG. 2A shows a more detailed view of cavity 104 including fluid 150 and wick 152. Wick 152 is used to facilitate capillary action in moving the condensed fluid 150 in cavity section 104*c* to the boiler section in cavity section 104*a*. Wick 152 may be a felt or cloth material, fiber glass, porous metals, wire screens, narrow grooves on the inner surface of the rotor, thin corrugated and perforated metal sheets, or any other suitable material or structure. Wick 152 may not be required in all embodiments and can be omitted if not needed.

Cavity 104 may be primed with at least enough fluid 150 to wet the entire wick 152. Additional fluid 150 may be added to prevent any portion of wick 152 in the boiler section from drying out due to evaporation. If a portion of wick 152 is devoid of fluid 150 in the boiler section, a hot spot may occur at that location on rotor 124. Fluid 150 may be water, acetone, glycol, ammonia or any other suitable fluid. Control of the cooling rate and of the rotor temperature is possible by varying the pressure in cavity 104*c* and by selecting fluids with different boiling points. For example, using water as fluid 150 at normal atmospheric pressure, the portion of rotor 124 surrounding cavity 104 may be maintained fairly close to 212° F., which is the boiling point of water.

Shaft portion 128, sleeve 134, and fins 132 may be partially or fully immersed in or wetted by a coolant 141. Coolant 141 is contained within chamber 142. Coolant 141 may, for example, be oil that is a part of an oil reservoir for the bearing, seal, and gear lubrication or may be any other suitable coolant. Water jacket 160 is used to cool coolant 141.

With pump 100 in operation, as the fluid being pumped within the cavities of casing 12 undergoes compression, the temperature of the fluid increases. This increase in fluid temperature occurs near output port 16 and causes surrounding rotors 124 and 126 and casing 12 to increase in temperature. A portion of the heat is dissipated by conduction through casing 12 into water jacket 40. Additional heat is dissipated by conduction through rotors 124 and 126 into cavity sections 104*a* and 106*a*. The heat transfer into cavity portions 104*a* and 106*a* causes fluid 150 to increase in temperature and undergo evaporation. The evaporation dissipates heat from cavity sections 104*a* and 106*a*. The evaporation also increases the pressure in cavity sections 104*a* and 106*a*, which drives evaporated fluid 150 towards cavity sections 104*c* and 106*c*.

With cavity sections 104*c* and 106*c* immersed in or wetted by coolant 141, their temperature is at a lower temperature than sections 104*a* and 106*a* and condensation occurs. The condensation transfers heat to cavity sections 104*c* and 106*c*. The condensation also decreases the pressure in cavity sections 104*c* and 106*c*, which helps draw evaporated fluid 150 from cavity sections 104*a* and 106*a*. The evaporation and condensation of fluid 150 establishes a pressure gradient across the length of cavities 104 and 106, which generates a continuous flow of evaporated fluid 150.

Condensed fluid 150 in cavity sections 104*c* and 106*c* is transported back to cavity sections 104*a* and 106*a* via the capillary action of porous wick 152. Alternatively, if the wick is omitted, the condensed fluid tends to flow back to the boiler section along the inside of the associated cavity. Condensed fluid 150 is then available for evaporation in order to begin the cycle again.

The heat that is transferred to cavity sections 104*c* and 106*c* is transferred by conduction through shaft portions 128 and 130, sleeves 134, and fins 132 to coolant 141. The heat is then removed from coolant 141 by water jacket 160.

There are several advantages to this type of heat removal approach. The heat transfer process within cavities 104 and 106 is due to vaporization in the evaporator section and condensation in the condenser section. Both of these processes have large heat transfer coefficients associated with them. This, in addition to the relatively large surface area of the external surfaces of screws 124 and 126 about cavities 104*a* and 106*a*, allows the pumped gas to be maintained at a significantly lower temperature than can be achieved solely with the cooling effect of water jacket 40. Using these cooling cavities in addition to an external water jacket allows the pumped gas to be maintained at an even lower temperature.

Another advantage is that the temperature of rotors 124 and 126 is more uniform during operation. This allows the rotors to be designed for closer operating clearance. This has a significant advantage on pump performance and the pumped fluid temperature since a closer operating clearance reduces internal leakage.

It will be understood that the foregoing is merely illustrative of one embodiment of the invention, and that various modifications can be made by those skilled in the art without departing from the scope and spirit of the invention. For example, porous wick 152 may be omitted or may not line cavities 104 and 106 in their entireties. Porous wick 152 may only line cavity sections 104*a* and 106*a*. With rotors 124 and 126 rotating, the centrifugal force on condensed fluid 150 in cavity portions 104*c* and 106*c* holds that fluid against the inner shaft walls. As evaporated fluid 150 condenses in cavity sections 104*c* and 106*c*, a buildup of condensed fluid 150 occurs. The buildup of fluid 150 is forced to flow towards cavity sections 104*a* and 106*a* due to the pressure difference generated by the varying fluid 150 depth along cavity sections 104*b*, 104*c*, 106*b*, and 106*c* (generally the deepest in cavity sections 104*c* and 106*c*).

Figure 4:
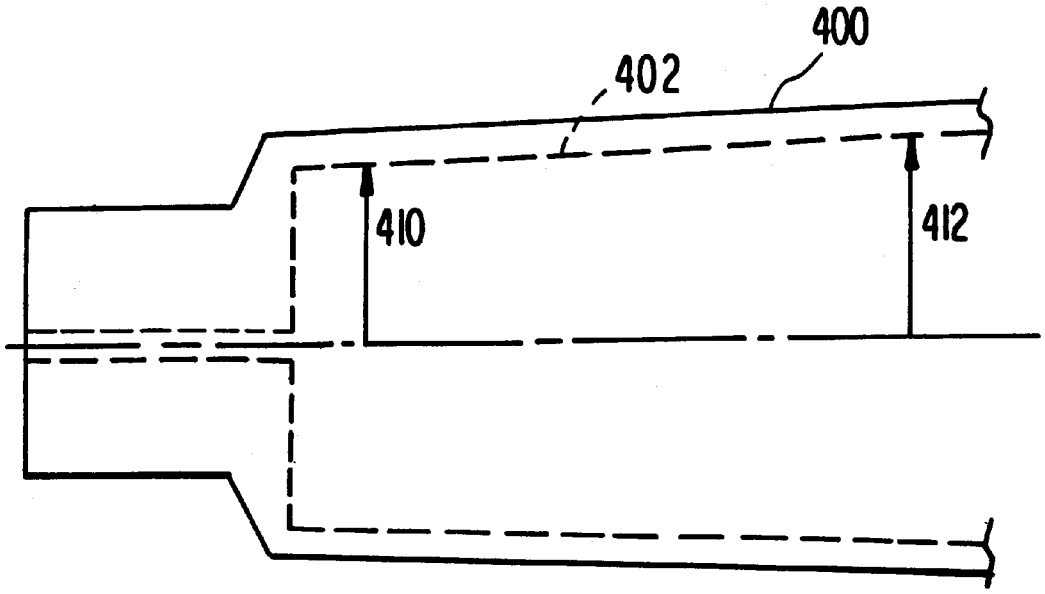
FIG. 4 is a simplified sectional view, partly in section, of an illustrative rotor in accordance with certain aspects of the invention.

In order to facilitate the flow of condensed fluid 150, the inner diameter of cavity portions 104*b*, 104*c*, 106*b*, and 106*c* may increase along the length of the cavities towards the evaporation section to further increase the pressure difference across the cavities. FIG. 4 shows such an alternative embodiment of rotors 124 and 126 in which the cavity varies in diameter along the length of rotor 400. Rotor 400 is a sectional view that includes the condenser and adiabatic sections of cavity 402. As shown, radius 412, which is located towards the evaporator section is larger than radius 410, which is located at the condenser side of cavity 402. The wall thickness of rotor 400 about cavity 402, as shown, is constant to ensure maximum heat transfer. Therefore, the outer diameter of rotor 400 also varies along the length of rotor 400. Alternatively, the outer diameter along the length of rotor 400 may be constant, which would result in the wall thickness at the condenser side to be greater than towards the evaporator side.

In another embodiment of the invention, the flow of condensed fluid 150 may be facilitated by angling the evaporator section of the cavities down to take advantage of gravity.

While the above-described embodiments of the invention are illustrated in use with a conventional screw pump, the invention may be used with any screw type pump, such as with a multi-stage screw pump or in a screw pump with more than two screws or any other type of dry pump technology such as multi-stage rotary claws or multi-stage rotary lobes.

One skilled in the art will appreciate that the present invention can be practiced by other than the described embodiments, which are presented for purposes of illustration and not limitation, and the present invention is limited only by the claims that follow.

What is claimed is:

1. A rotary screw pump comprising:

a casing that includes an inlet and an outlet;

first and second intermeshing screw members rotatably mounted within the casing configured to (1) draw a first fluid from the inlet, (2) transport the first fluid to the outlet, and (3) expel the first fluid through the outlet, wherein the first fluid undergoes compression that generates heat at the outlet side of the casing;

first and second shaft portions connected to the first and the second screw members, respectively, and that extend out from the outlet side of the casing;

a first cavity within the first screw member and the first shaft portion; and a second cavity within the second screw member and the second shaft portion, wherein the first and the second cavities are sealed and include a second fluid for transferring the heat generated during compression to the first and second shaft portions.

2. The rotary screw pump defined in claim 1 further comprising:

a chamber into which the first and the second shaft portions extend; and coolant in the chamber that allows the heat from the first and the second shaft portions to be transmitted to the coolant.

3. The rotary screw pump defined in claim 2 wherein the first and the second shaft portions are partially immersed in or wetted by the coolant.

4. The rotary screw pump defined in claim 2 further comprising fins attached to the first and the second shaft portions to facilitate the heat transfer from the first and the second shaft portions to the coolant.

5. The rotary screw pump defined in claim 2 further comprising a water jacket surrounding at least a portion of the chamber that allows the heat from the coolant to be transmitted to the water jacket.

6. The rotary screw pump defined in claim 2 further comprising a water jacket surrounding at least a portion of the casing that allows the heat generated from compression to be transferred to the water jacket.

7. The rotary screw pump defined in claim 2 further comprising a bearing and a seal located between the cavity and the chamber, wherein the coolant is oil that is a part of an oil reservoir for the bearing and seal.

8. The rotary screw pump defined in claim 2 further comprising timing gears located within the chamber and attached to the first and second shaft portions that are configured to insure that the first and the second screw portions rotate at the same speed in opposite directions.

9. The rotary screw pump defined in claim 2 wherein the first shaft portion extends out from the side of the chamber opposite from where it enters the chamber, the system further comprising a motor located external to the chamber, which powers the first and the second screw members from the end of the first shaft portion extending out of the chamber.

10. The rotary screw pump defined in claim 1 wherein the first and second cavities are lined with a porous wick.

11. The rotary screw pump defined in claim 1 wherein the porous wick is selected from the group consisting of felt material, cloth material, fiber glass, porous metals, wire screens, thin corrugated metal sheets, and perforated metal sheets.

12. The rotary screw pump defined in claim 1 wherein the first and the second cavities and the second fluid are configured to (1) allow the second fluid to evaporate in the portion of the first and second cavities within the casing and (2) allow the evaporated second fluid to condense in the portion of the first and second cavities within the first and the second shaft portions.

13. The rotary screw pump defined in claim 12 wherein the first and second cavities within the first and second shaft portions are conoidal in shape in order to facilitate the flow of the condensed second fluid towards the casing end of the first and second cavities during rotation of the first and second screw members.

14. The rotary screw pump defined in claim 12 wherein the first and second cavities are sloped down in order to allow gravity to facilitate the flow of the condensed second fluid towards the casing end of the first and second cavities.

15. The rotary screw pump defined in claim 1 wherein the first and second cavities within the first and the second screw members follow the shape of the first and second screw members.

16. The rotary screw pump defined in claim 1 wherein the first and the second shaft portions include access holes that allow the first and the second shaft portions to be charged with the second fluid.

17. The rotary screw pump defined in claim 1 wherein the second fluid is selected from the group consisting of water, acetone, glycol, and ammonia.

* * * * *